US007695276B2

(12) United States Patent
Evans

(10) Patent No.: US 7,695,276 B2
(45) **Date of Patent: *Apr. 13, 2010**

(54) FURNACE, ITS METHOD OF OPERATING AND CONTROL

(75) Inventor: Thomas Hudson Evans, Swansea (GB)

(73) Assignee: Platinum Controls Limited (GB)

( * ) Notice: Subject to any disclaimer, the term of this patent is extended or adjusted under 35 U.S.C. 154(b) by 747 days.

This patent is subject to a terminal disclaimer.

(21) Appl. No.: 10/546,813

(22) PCT Filed: Feb. 26, 2004

(86) PCT No.: PCT/GB2004/000781

§ 371 (c)(1),
(2), (4) Date: Aug. 24, 2005

(87) PCT Pub. No.: WO2004/076924

PCT Pub. Date: Sep. 10, 2004

(65) Prior Publication Data

US 2006/0199125 A1 Sep. 7, 2006

(30) Foreign Application Priority Data

Feb. 26, 2003 (GB) ..... 0304306.4

(51) Int. Cl.
*F27B 7/00* (2006.01)

(52) U.S. Cl. ..... 432/103; 432/250; 110/246

(58) Field of Classification Search ..... 432/103, 432/108, 110, 117, 118, 250; 75/672, 585; 266/173, 163, 213; 110/246, 245
See application file for complete search history.

(56) References Cited

U.S. PATENT DOCUMENTS

| | | | | |
|---|---|---|---|---|
| 2,999,396 | A * | 9/1961 | Kaczmarski | 474/139 |
| 3,963,416 | A * | 6/1976 | Mach | 266/145 |
| 4,040,820 | A * | 8/1977 | Loach et al. | 75/672 |
| 4,456,476 | A * | 6/1984 | Sherwood | 75/509 |

(Continued)

OTHER PUBLICATIONS

Avallone, E.A.; Baumeister, T., III (1996). Marks' Standard Handbook for Mechanical Engineers (10th Edition). (pp. 8-59-8-64). McGraw-Hill.*

*Primary Examiner*—Gregory A Wilson
(74) *Attorney, Agent, or Firm*—William H. Bollman

(57) ABSTRACT

The present invention relates to a furnace (10), its method of operation and control. The invention overcomes problems associated with existing furnaces by improving the recovery rate of waste metal. In a preferred embodiment the furnace (10) comprises a cylindrical body of constant internal diameter. The furnace body (12) is mounted on a frame (15) pivoted to a ground members (16*a* and 16*b*), the furnace body (12) is adapted to be reclined or inclined or at various angles (α and ⊖); a burner (30) to heat the furnace, and a door (19*a*, 19*b*) for sealing an open end (14). As the internal walls of the furnace body (12) are of a constant diameter, it is no longer necessary to incline the furnace (10) to such a degree in order to pour molten metal, because there is no narrow neck (which previously acted like a weir). In a preferred embodiment combustion air is routed through the door hinge to the burner (30). As a result the air/fuel delivery system has gas tight rotary and elbow joints is attached to the furnace (10) and tilts and moves with the furnace (10). An artificial intelligence system monitors process variables and controls the operation of the furnace (10).

37 Claims, 7 Drawing Sheets

U.S. PATENT DOCUMENTS 5,421,850 A * 6/1995 Dube et al. ..... 75/672
5,496,450 A * 3/1996 Blumenthal et al. ..... 205/782
5,688,470 A * 11/1997 Spoel ..... 266/87
6,213,763 B1 * 4/2001 Slade et al. ..... 432/103
6,395,221 B1 * 5/2002 Yerushalmi ..... 266/213
7,160,501 B2 * 1/2007 Summer ..... 266/173
2002/0074700 A1 * 6/2002 Mansell ..... 266/213

* cited by examiner

VIEW ON ARROW Y

SECTION ON X-X

FURNACE, ITS METHOD OF OPERATING AND CONTROL

FIELD OF THE INVENTION

The present invention relates to a furnace, its method of operation and control.

More particularly the invention relates to a furnace, to a method of operating a furnace and to a method of controlling a furnace in order to recover nonferrous metals, such as, for example, and without limitation: copper, lead and aluminium. The invention is particularly well suited for the recovery of aluminium.

BACKGROUND

Furnaces for the recovery of metals, such as aluminium, are well known. Increasingly there is a demand for such furnaces, as legislation tends to encourage recovery and recycling of materials, particularly waste metals. There are also environmental benefits in recovering waste metals, rather than mining and smelting virgin ore. Aluminium is particularly well suited for mixing recovered (waste) aluminium with new aluminium material.

For the purposes of the present specification and the understanding of the invention, the furnace, its methods of operation and control will be described with reference to recovery of aluminium. However, it will be understood that variation to materials, operating conditions and parameters may be made so as to modify the furnace in order to enable recovery of other non-ferrous metals.

Furnaces for recovering waste aluminium have a heating system which melts the aluminium. A flux is introduced into the furnace to assist with the aluminium recovery. The flux generally consists of NaCl and KCl, other chemicals such as cryolite, may be added to the flux. The flux or salt cake assists in the process and is a well-known art. At elevated temperatures, typically from 200° C. -1000° C., the melted flux floats on the molten aluminium, as it is less dense. Pouring of recovered liquid aluminium is then possible by tipping or tilting the furnace in such a way that the flux remains in the furnace.

PRIOR ART

Existing metal recovery furnaces have a generally cylindrical body which is pivoted to a stand so that it can move from a first, predetermined, generally horizontal heating phase position (whilst aluminium is melting) to a second, inclined pouring position, at which position molten aluminium can be poured. Some existing furnaces have bodies that have an open end that tapers inwards. Waste aluminium is loaded into the furnace and molten aluminium is poured from the furnace at the open end.

An example of a metal recovery furnace with an inwardly tapered open end is described in European Patent Application EP-A3-1243663 (Linde AG). A process for melting contaminated aluminium scrap is described. The process comprises: measuring the oxygen content of waste gas produced on melting the scrap; and using the value as a control parameter during pyrolysis of the impurities and/or during melting of the aluminium.

Other types of furnace were fitted with one or more furnace doors. The furnace door(s) were provided at the open (pouring) end of the furnace. Sometimes furnace doors supported a furnace heater. The door(s) was/were hinged to a fixed point separate from the cylindrical body of the furnace. Therefore it was only possible to close the furnace doors when the cylindrical body of the furnace was in a predetermined position.

A requirement was that the furnace was able to adopt a predetermined position in order to retain molten metal. The fact that existing furnaces had to adopt this position meant that the furnace could only be operated at one angle. This was to some extent alleviated by using an inwardly tapered open end, which defined a reservoir within the furnace in which melted aluminium flowed. When it was desired to pour out the melted aluminium, for example into a launder (refractory receptacle), sometimes the flux poured out with the molten material because it was difficult to separate the flux from the molten aluminium. One reason for this was that existing furnaces had to be tipped to such an angle in order to cause or permit molten aluminium to be poured. The result was that a mix of flux and molten aluminium were sometimes poured and a scraper was often required to separate the two. Also, to some extent the tapered end reduced the size of the open end of the furnace body, thereby limiting the size of objects, which could be placed in the furnace.

With the door closed it was not possible to view the melting process. Inadvertent opening of the door lead to an exothermic reaction, resulting in the aluminium being burnt away upon reaction with excess oxygen.

The invention provides a furnace that overcomes the above problems associated with existing furnaces.

Another object of the invention is to provide a furnace which has a greater recovery rate of waste metal than has hereto for been achievable.

SUMMARY OF THE INVENTION

According to the present invention there is provided a furnace comprising: a generally cylindrical furnace body having a closed and open end of generally constant diameter, a frame pivoted to a ground member, said frame supporting the furnace body for rotation at various angles in a reclined position away from the open end and in an inclined position towards the open end, a burner to heat the furnace, and a door to seal the open end.

As a result of the generally constant diameter of the internal walls of the cylinder of the furnace it is no longer necessary to incline the furnace to such an exaggerated angle in order to pour molten metal. In addition, once poured a much higher percentage of molten metal can be obtained, because there is no longer confinement of residue within the furnace as a result of a lip or neck.

Ideally the door is hinged to the frame that supports the furnace and is capable of displacement in unison with the inclining (raising and lowering) of the furnace. An advantage of this is that the doors are always maintained in close proximity with the mouth of the furnace. The beneficial effects of this are two fold: firstly there is less risk of oxygen entering the furnace (which could contaminate the atmosphere) and secondly, because the furnace is maintained in a closed state during its operation, heat losses are reduced. Thus efficiency is increased, as less energy is required to melt the aluminium. Therefore it is apparent that the use of the invention provides a cost effective (and more profitable) aluminium recovery process.

Preferably the, or each, door has one or more inspection hatches to view the melting process and/or through which molten material can be poured. Because the area of the, or each, inspection hatch(es) is (are) smaller than the door itself, less energy escapes on inspection of the inside of the furnace.

Advantageously the, or each, door has two halves hinged to either side of the frame. In an exemplary embodiment the hinges act as integral air/fuel delivery ducts enabling the furnace doors to be closed and heating to take place in a controlled atmosphere.

Preferably the heater is a gas burner and is mounted on the door as hereinafter described. In a particularly preferred embodiment the combustion air is routed through the furnace door hinge to the burner. The air and fuel gas delivery system (air and gas train) is attached to the furnace and is also able to tilt and move with the furnace. This is achieved using elbow and/or rotary fluid connections employing rotary joints that are gas tight.

According to another aspect of the invention there is provided a furnace comprising: a generally cylindrical furnace body having a closed and open end of generally constant diameter; a frame pivoted to a ground member, said frame supporting the furnace body for rotation at various angles in a reclined position away from the open end and in an inclined position towards the open end, there being a door which opens and closes by swivelling on a hinge and a burner for heating the furnace, whereby air and/or gas is delivered to the burner by way of a manifold supported, by or passing through, the hinges.

This is achieved using elbow and/or rotary fluid connections employing rotary joints that are gas tight. As a result the air and fuel gas delivery system (air and gas train) is able to tilt and move with the furnace.

The burner is ideally mounted in one door, at an angle and in such a way that a gas jet, emanating therefrom, does not impinge on the payload material being processed. An advantage of this is that heat is never applied directly to the payload. Therefore, unlike with existing furnaces, there is less risk of oxidising the molten metal to be recovered. The corollary of this is that yield is further improved.

Conveniently the burner is a high velocity type burner, but other types of burners may be employed. Typically the thermal rating of the burner is determined by the size and throughput of the furnace, but is not usually less than 1200 kW.

The angle of the burner mounted in the door or doors is such that it ensures optimum heat transfer into the refractory and into the material being processed and ideally aims the jet towards the end wall of the interior of the furnace body.

Preferably the furnace has an exhaust port. An air jet or air curtain is provided across the exhaust port to control the pressure within the furnace. The air jet or air curtain enables pressure balancing of the internal atmosphere of the furnace with respect to the external atmosphere. This feature further enhances energy efficiency and recovery as the air curtain effectively seals the furnace, thereby reducing oxygen in the internal atmosphere, thus reducing oxidation. Moreover because there is a sealing effect, less energy is lost from the furnace, for example as a result of convection losses. Thus the air curtain at the furnace door exhaust helps to control the furnace pressure and furnace conditions. The air curtain is preferably dimensioned and arranged to suit the size of furnace and application.

Artificial intelligence control system, such as a fuzzy logic neural network control system, controls important process variables and process sub-variables are described below.

Conveniently one or more sensors is/are provided to sense the temperature of a refractory liner and molten material.

Temperature sensors in the furnace doors are directed at refractory linings and/or material being processed to measure the temperature of the refractory and material being processed. Knowledge of the external furnace skin temperature and distribution of heat across the exterior surface of the furnace, enables greater control of the heating regime.

A plurality of sensors, placed in a known relationship one with another, enable averaging of furnace temperature to be obtained as well as providing important information as to thermal transients in the furnace temperature.

Conveniently a circumferential ring supports a toothed gear which is connected to a drive system. The drive system may comprise a drive motor or is chain driven and is adapted to engage with sprockets or gear teeth disposed around an outside surface of the furnace. Where a chain drive is used ideally the number of sprocket teeth on the circumferential ring, around the furnace girth, is half that of the chain pitch. This reduces drag and chain wear and therefore reduces power requirement of the drive motor. Additionally the lives of the chain and sprocket are increased.

Packaging wedges are ideally employed to ensure a close fit between a circumferential ring (on which the furnace rotates), and the outer surface of the furnace. These wedges are ideally connected using a threaded member which when tightened causes the wedge to pinch the ring and ensure tight grip concentric with surface mounted lugs and the ring. This is necessary due to differential thermal expansion that occurs when cycling the furnace through its operating regime.

Ideally the drive motor can rotate the furnace at a variable rotational speed. The rotation of the furnace serves to churn the material being processed and transfer heat into the material via the refractory. Ideally, agitation is achieved by rotating and counter rotating the furnace, (this is achieved by rapid actuation of an alternating current (AC) electric motor), at predetermined and selected operating angles and speeds.

The electric motor is connected to the furnace as mentioned above either: by way of a fixed linkage such as a gear, rack and pinion; or ideally a chain drive. The combination of electric motor, motor controller and linkage mechanism is hereinafter referred to as a furnace rotation system. The furnace rotation system is advantageously controlled for braking purposes by using a dynamic braking system. An inverter is used to control the motor for braking purposes and direct current (DC) is controllably injected as part of a dynamic braking system.

The dynamic braking system involves the steps of: injecting direct current (DC), under control of a feedback loop, based upon a signal which is obtained from one or more sensors sensing load characteristics of the furnace. Such furnace load characteristics include: required torque and smoothness of rotation. In order to rapidly decelerate the furnace, a controller obtains a DC value based upon the configuration of the invertors, parameters and outputs a feedback signal which is used to control the level and rate of injection of the DC for slowing the motor and/or holding the motor in a particular orientation. The furnace and its contents are thereby held in a predetermined position. As the molten metal is denser than the flux the metal drops to a lower region of the furnace from where it can be readily poured or counter rotated to achieve optimum mixing of waste material and flux (churning).

Because the walls of the interior of the furnace are parallel and cylindrical with a furnace door covering the open end of the furnace, pouring of the melt at a lower angle of inclination (tipping angle) is achieved. When this is desired the furnace is inclined preferably by extending two hydraulic rams or jacks.

According to a yet further aspect of the invention there is provided a method of operating a furnace comprising the steps of: loading the furnace with a mixture of flux and a material to be melted, from which metal is to be recovered; heating the mixture until the metal melts; agitating the mixture so as to promote agglomeration of the molten metal; and inclining one end of the furnace in order to pour the molten metal.

The method of operating the furnace may be repeated by reclining the raised end, introducing fresh material to be melted, from which metal is to be recovered, agitating the mixture so as to promote agglomeration and raising one end of the furnace in order to pour recovered metal.

Preferably the angle of inclination is less than 20°, more preferably the angle of inclination is less than 15°, most preferably the angle of inclination is less than 10°.

According to a yet further invention there is provided a method of controlling a furnace comprising the steps of: controllably heating a furnace, by controlling at least the following conditions: the temperature; the mass of payload; the viscosity of the payload; the time to reach the viscosity; the atmospheric oxygen content of the furnace; the rate of application of energy and the cumulative energy applied.

The furnace door, or doors, is/are fitted with inspection doors or hatches that can be opened during the process to check the condition of the material being processed with a minimum release of energy. However, monitoring of the aforementioned variables is ideally achieved by way of a plurality of sensors and a remote data acquisition system such as a Supervisory Control And Data Acquisition, (SCADA) system. Ideally the SCADA system is incorporated in furnace control equipment and collects and analyses all furnace data and control inputs and outputs.

Use of SCADA systems enables on-line diagnosis of the process and remote access support. This aspect of the invention improves on-line monitoring and electronic archiving. A dedicated field communication data bus wiring system for example PROFI-BUS (trade Mark) is ideally used in preference to multi-core cabling networks. Local and remote control boxes receive and encode signals for process sensors which are ideally positioned to measure process variables incorporated into the furnace process control system, for example and without limitation, furnace skin temperatures, refractory temperatures, fuel gas and air flows and pressures.

Preferably the angle of the frame is altered by means of hydraulic ram(s) whereby to support the body for rotation at various angles in a reclined position away from the open end and in an inclined position towards the open end. The hydraulic rams are ideally water-glycol heat resistant type.

Preferably the frame is pivoted to the ground member such that the pivotal axis is in alignment with a pouring lip at the open end of the furnace body.

Preferably the furnace is adapted to recover waste aluminium.

All of the aforementioned contribute to higher metal recovery yields, lower energy usage, lower flux usage and faster cycle times.

The furnace combustion system can operate on several fuels, natural gas, propane, heavy fuel oil, light fuel oil, oxy fuel etc.

BRIEF DESCRIPTION OF THE FIGURES

An embodiment of the invention will now be described with reference to the accompanying drawings in which.

DETAILED DESCRIPTION OF THE INVENTION

Figure 1:
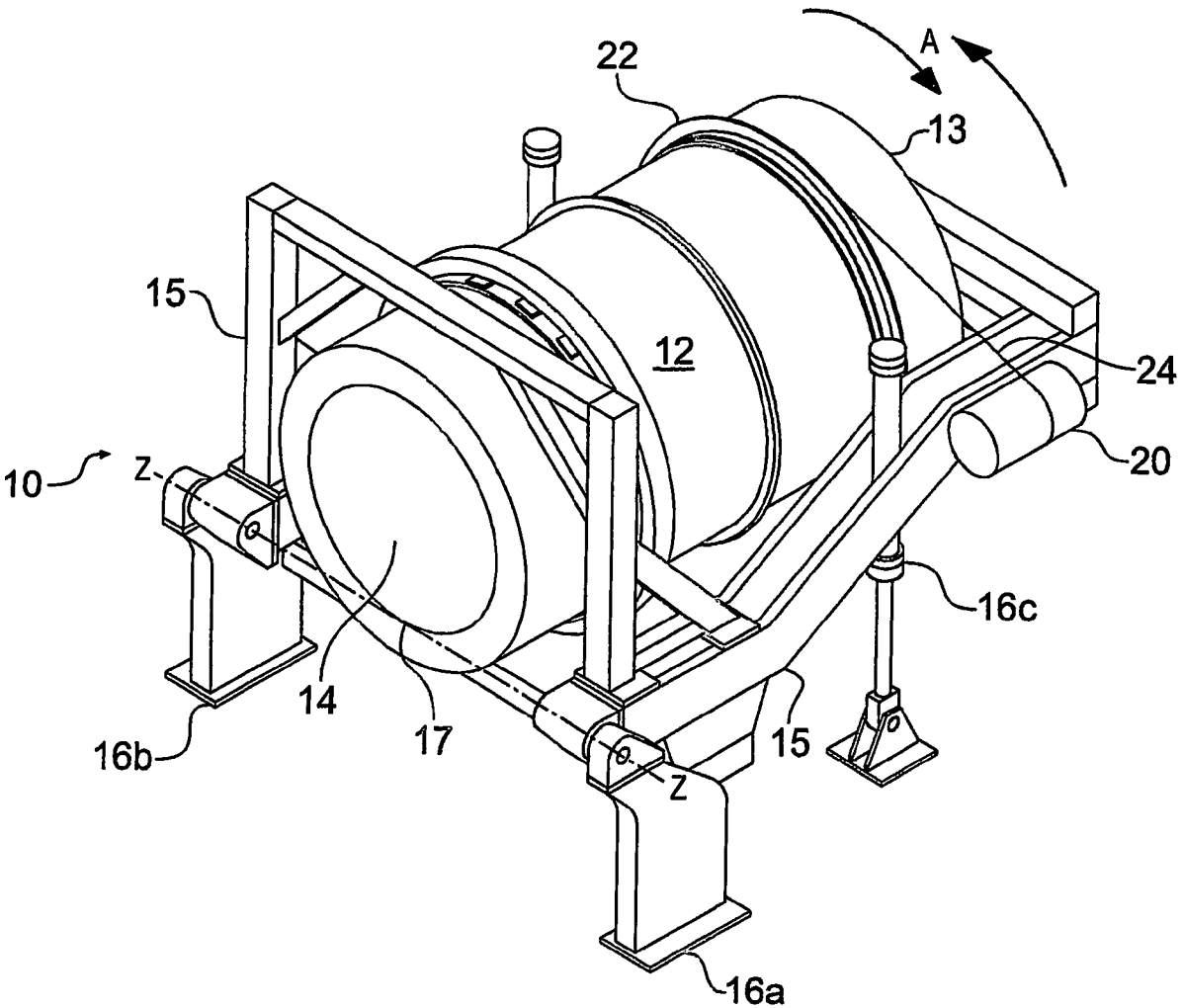
FIG. 1 shows a perspective view of a preferred embodiment of a furnace (with the door removed) showing a furnace body, a support frame and a drive system.
Figure 3:
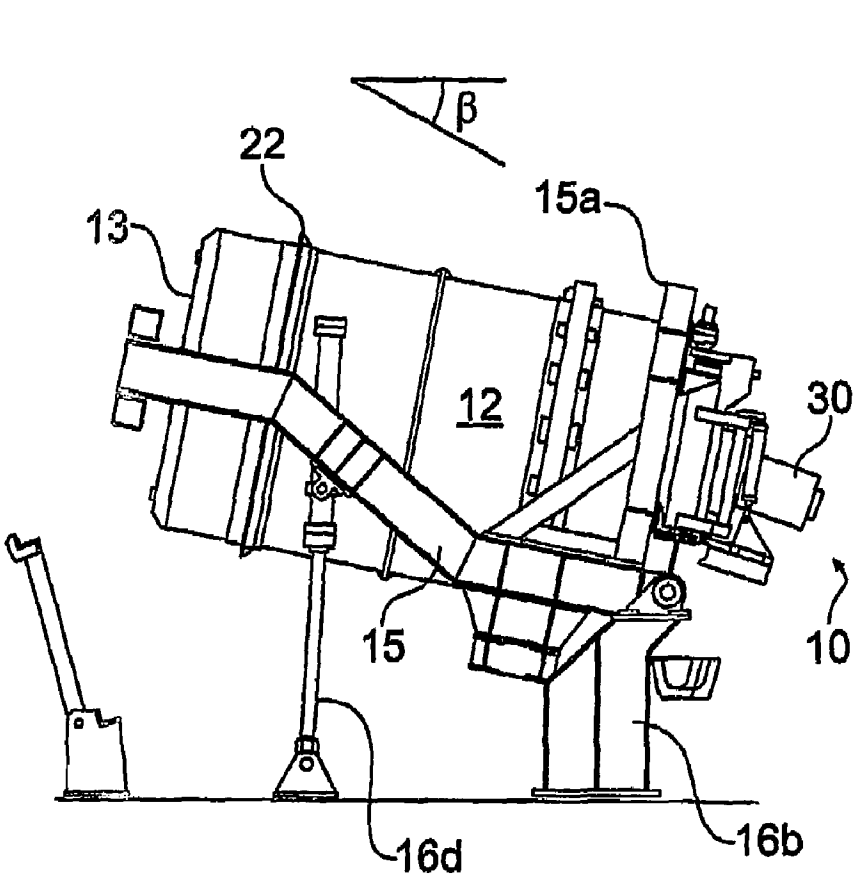
FIG. 3 shows a side view of the furnace shown in FIG. 1, with the furnace in a raised position for tipping or pouring, at an inclined angle (β)
Figure 2:
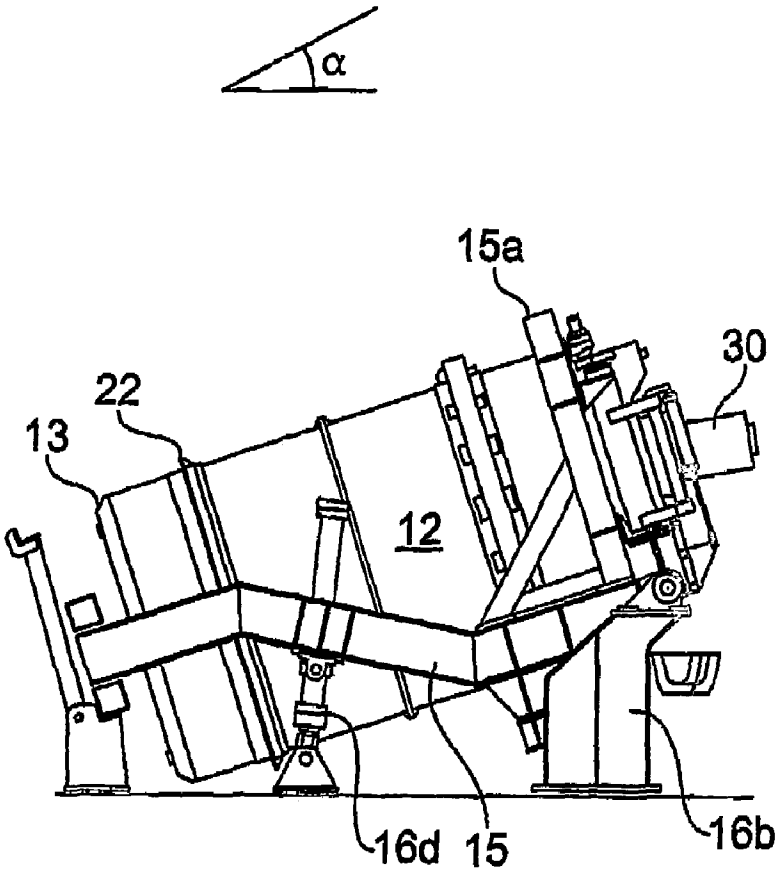
FIG. 2 shows a side view of the furnace shown in FIG. 1, with the furnace at a reclined angle (α)
Figure 5:
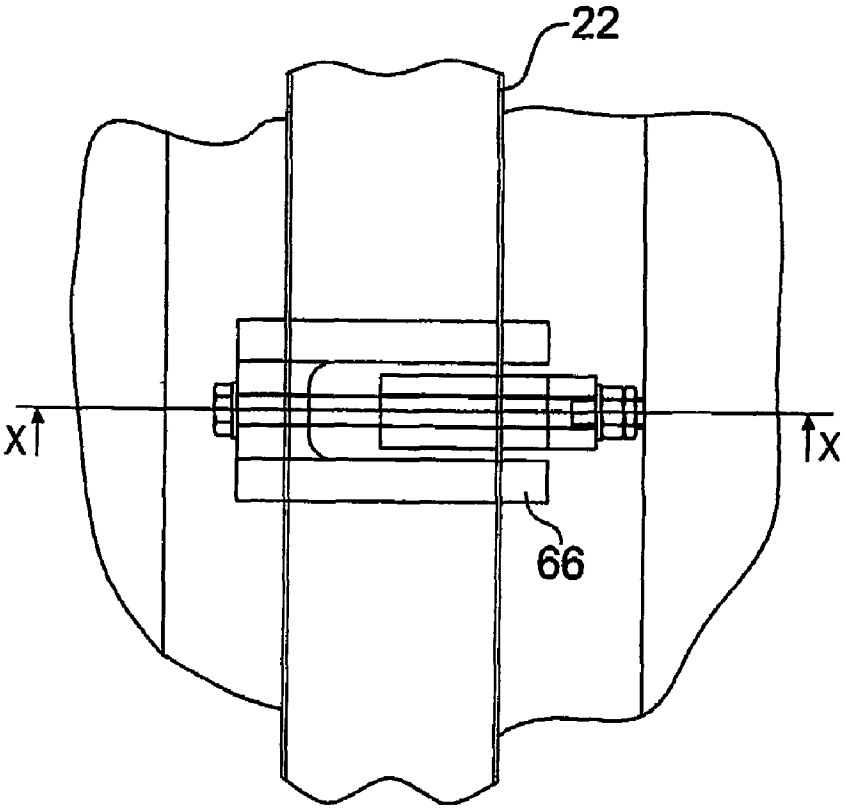
FIG. 5 is a view along arrow Y of FIG. 4, showing a plan view of one of the packing wedges urged in contact against the steel "tyre" surrounding the furnace.
Figure 4:
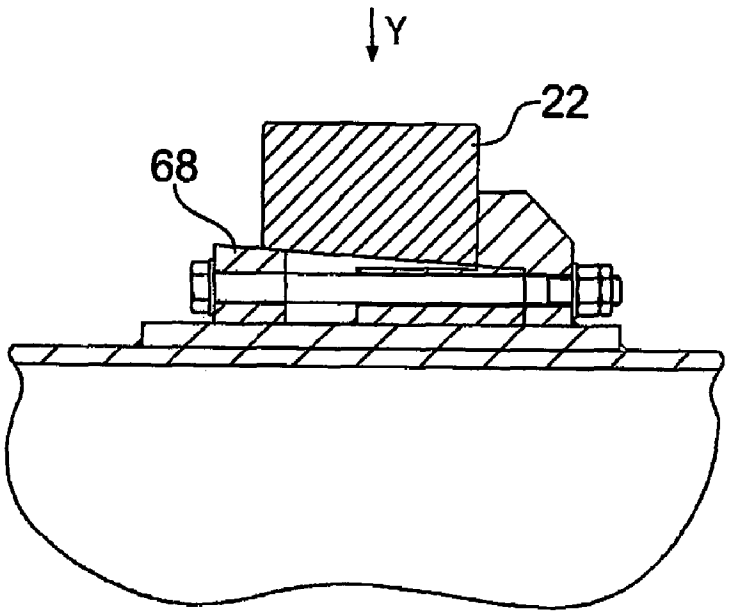
FIG. 4 shows a part section view along line X-X of FIG. 5, showing a section of one of typically 18 packing wedges urged in contact against a steel "tyre" surrounding the furnace.

Referring to the Figures generally and FIGS. 1 to 3 in particular, there is shown a furnace 10. Furnace 10 has a generally cylindrical furnace body 12 of generally constant external diameter and internal diameter, as a result of parallel sidewalls. Furnace body 12 has a closed end 13 and an open end 14. Body 12 may be formed from steel and lined internally using refractory linings or bricks as is well known in the art. Examples of refractory linings or bricks are STEIN 60 P (Trade Mark) and NETTLE DX (Trade Mark).

The frame 15 is provided to support the furnace body 12 for clockwise and counter clockwise rotation as shown by arrows A. To rotate body 12, frame 15 may include support wheels on which the body 12 rests and a motor 20 driving a toothed wheel 22 on the body 12. Torque is transmitted from the motor 20 to the toothed wheel by way of a chain 24.

Frame 15 is pivoted to a ground support member in the form of feet 16A and 16B secured to the ground, providing a pivotal axis "Z-Z". The frame angle can be altered relative to the feet 16*a*, 16*b* such that the frame 15 can support the body 12 for rotation at various angles (α) from the horizontal, in a reclined position away from the open end (furnace mouth) and (β) in an inclined position towards the open end. The angle of inclination of the frame is altered by means of hydraulic rams 16*c*, 16*d*. Hydraulic rams 16*c* and 16*d* are ideally of the water-glycol heat resistant type.

Furnace body 12 has a pouring lip 17 at the lowest point of the open end 14, and the pivotal axis "Z-Z" is in alignment with a pouring lip 17 at the open end 14 of the furnace body 12.

Figure 6C:
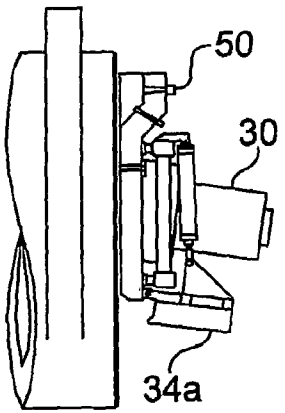
FIGS. 6B and 6C show side views of the door of the furnace.
Figure 6B:
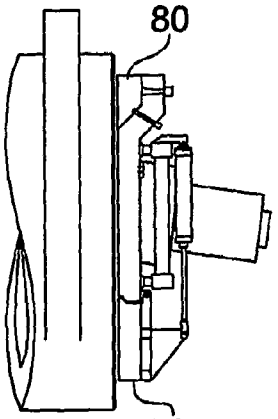
Figure 6A:
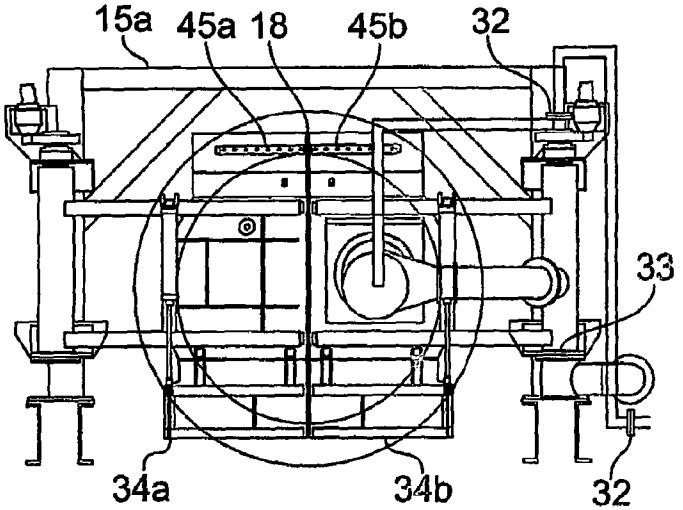
FIG. 6A shows a front view of the door of the furnace.
Figure 6D:
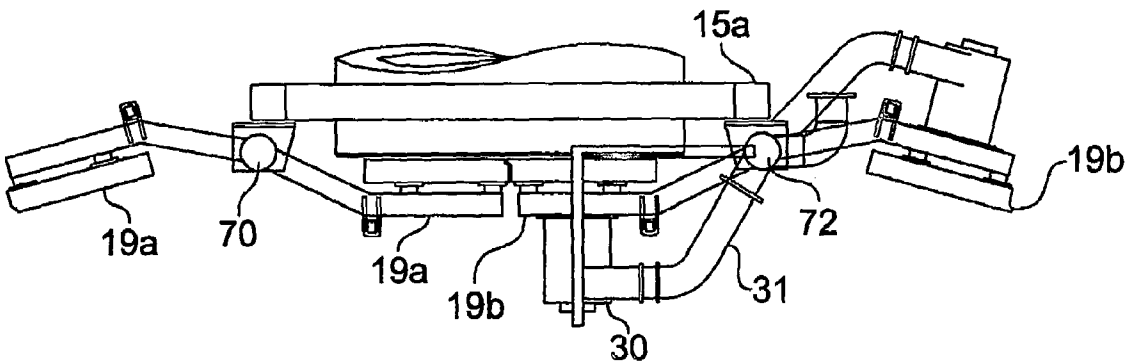
FIG. 6D shows a diagrammatical above plan view of the doors of the furnace (in both open and closed positions), so as to illustrate rotating air and gas inlet manifolds.

As shown in FIGS. 6*a*, 6*b* and 6*c*, frame 15 has at one end a door support structure 15*a* to which is hinged a door 18 to seal the open end 14. Door 18 has two doors 19*a* and 19*b* hinged to opposing sides of the door support structure 15A. Doors can swing away from open end 14 to allow the furnace to be loaded or molten metal to be poured out, or the doors can swing towards the open end 14 to seal it. In practice there is a gap between the doors and the open end 14 when the doors seal the open end.

A burner 30 is provided on door 19*b*. Burner 30 can be fed fuel (such as natural gas) and air through a feed pipe or duct 31, with gas being supplied via a gas rotary joint 32 and air being supplied through an air rotary joint 33. Feed pipe 31, gas rotary joint 32 and air rotary joint 33 are collectively referred to as fuel delivery system. The reach of combustion gasses from the burner 30 can be as great as 4 m or even 6 m in longer furnaces. Because the gas delivery system is effectively able to move in two orthogonal planes, by way of rotary joints 32 and 33, it is possible to swing open the (or each) furnace door(s), as well as tilt the furnace on hydraulic rams 16*c* and 16*d*, with the burner(s) 30 operating.

Doors 19*a* and 19*b* each have an inspection hatch 34*a* and 34*b* to view the melting process and/or through which molten material can be poured. This is an advantage over previously known furnaces as explained above.

Temperature sensors (not shown) are provided to sense the temperature of a refractory liner and molten material. The sensors are fitted to the outside of the furnace body 12. An aperture is ideally provided in a door enabling a sensor to "view" inside the furnace 10. An airflow cooling jacket (not shown) is optionally provided to allow temperature sensors to operate at low ambient temperatures to prevent damage to them. The airflow cooling jacket also acts as a purge to keep the sensors and other instrumentation free of dust and smoke and sight vision clean.

Air curtains 45*a* and 45*b* are provided for each door 19*a* and 19*b*. The air curtains 45*a* and 45*b* enable fine balancing of the internal atmospheric pressure.

Pressure differential between the internal furnace atmosphere and external (ambient) pressure can therefore be controlled accurately by balancing the air curtain(s) across the exhaust port 80.

The furnace 10 has an exhaust port 80 in the door (or doors), and an air jet 50 is provided to control the furnace pressure. The percentage oxygen in the furnace 10 atmosphere is ideally 0% and this is controlled as one of the variables by decreasing air mass flow rate to fuel ratio. By maintaining the percentage of oxygen at or around this level, when the aluminium becomes plastic, the risk of oxidation is reduced with the result that yield is improved.

The furnace 10 is ideally adapted to recover waste aluminium and is therefore loaded in use with NaCl and KCl and in some cases small amounts of other chemicals such as cryolite to assist in the aluminium recovery process.

In use the body 12 of the furnace 10 is reclined away from the open end so that the closed end is lower than the open end. In this position the furnace is said to be reclined or tilted back. The doors 19*a* and 19*b* can swing away from open end 14 to allow the furnace body 12 to be loaded. The wide-open end facilitates this process. The doors 19*a* and 19*b* can then swing towards the open end 4 to seal it. The burner 30 is then operated to melt the metal in the loaded body 12.

Because the body 12 is reclined, molten metal does not pour out of the open end. The furnace thus obviates the need to have a small tapered end as with previously known furnaces making for easy loading and the ability to load large objects, and most importantly easier and more complete pouring of the molten metal. Because the doors 19*a* and 19*b* are hinged to the frame 15, the doors can be closed whatever the angle of inclination ($\alpha$ or $\beta$) of the furnace body. Doors 19*a* and 19*b* can later swing away from open end 14 to allow molten metal to be poured out.

In recycling metal such as aluminium, there are a number of different variables. These include: types of flux and percentage thereof, heat applied (both duration and temperature), melt losses, method of charging, types and weight of process material, condition of spent flux and residual oxides, rotational speed and direction of the furnace body and angle of inclination. Other variables that may be used in the operation and control of the furnace include: the mass flow rate of compressed air, ambient air temperature, calorific value of fuel delivered and rate of fuel delivery.

The above mentioned, and possibly other variables, for example when recovering other metals, are ideally controlled by a furnace management system, which incorporates a processor (such as a micro-processor in a personal computer), which may also form part of the furnace of the present invention.

Shock loading of the drive motor 20 can be monitored using current feedback information form the controller (not shown) of the drive motor 20. The nature of the current feedback from driving the motor 20 in order to rotate the furnace 10 with solid ingots, waste and scrap metal pieces tends to be spiky. As soon as the material melts, and the molten material agglomerates, the rotational characteristics of the furnace 10 becomes much smoother and transients in loading on the motor 20 are reduced eventually disappearing at steady state. Data relating to this information can be used with other variables to determine when it is optimum to pour aluminium.

Previously operating variable settings were determined by experienced furnace operators throughout the process cycle, each individual operator having his own preference for each variable setting or range of settings. There has therefore been a loss of consistency in variable settings during the process cycle with a corresponding variation in metal recovery rates.

Control and monitoring of the variables directly contribute towards achieving highest possible recovery rates. As with many engineering systems it is not always possible to optimise all variables at the same instant during the recovery process. For example, too much heat input when the aluminium is in the plastic or melted stage tends to cause the aluminium to oxidise due to its affinity with oxygen. This greatly reduces recovery yield. The amount of oxygen in the burner 30 is ideally reduced at certain stages of the process cycle in order to maximise recovery. However, this is often at the expense of fuel cost. The variables therefore require to be monitored carefully and continuously during and throughout the process.

Experienced operators achieve varying recovery rates. By monitoring variables and with the use of an artificial intelligence system with optimised ranges of variables the aspect of the invention which ensures that the variable settings are optimised at all times removes inconsistencies from operation and improves yields.

The following lists some of the process variables that are monitored to recycle aluminium:

1. The type of flux used and percentage of flux mix in relation to sodium chloride (NaCl) and potassium chloride (KCl). The percentage of flux used per type of metal product processed, for example crushed beverage containers may require more flux than say a large solid engine block. Processing dross generally requires more flux than say general aluminium scrap.
2. The temperature of the flux needs to be controlled during the process, as does the instant at which fresh flux is introduced and at what percentage. Determination of when flux is spent is ideally also made.

3. The amount of heat required to process different types of product is an important variable. Temperature requirements for different types of product may be stored, for example on look-up tables and used to compute the amount of time required for heating different types of product.
4. Exhaust gas temperatures for different alloys are monitored to provide an indication of the extent of a process.
5. Melt losses, (the amount of aluminium lost during the process) provides an indication of the yield of recovery of a process. Prior knowledge of different melt losses per types of alloys processed may be used to enhance efficiency of recovery.
6. The effect of temperature on various alloys; the effect of time and temperature required for different alloys.
7. Method of charging process material differs according to the nature of charging dense and light products and effects of the same. Percentage weights of product charged for best recovery results.
8. Condition of spent flux and residual oxides as well as the amount of aluminium contained in the spent flux. The condition of the spent flux, residual oxides and the amount of aluminium contained therein is a process variable which is also influenced by other process variables. Condition monitoring and information feedback into the controls system is therefore advantageous.
9. The rotational speed and incline angle of the furnace. The rotational speed of the furnace accommodates different products. Rotational direction of the furnace, (clockwise or anti-clockwise), during the process. Angle of repose during the furnace cycle is typically between 0° and 20°.

Figure 7A:
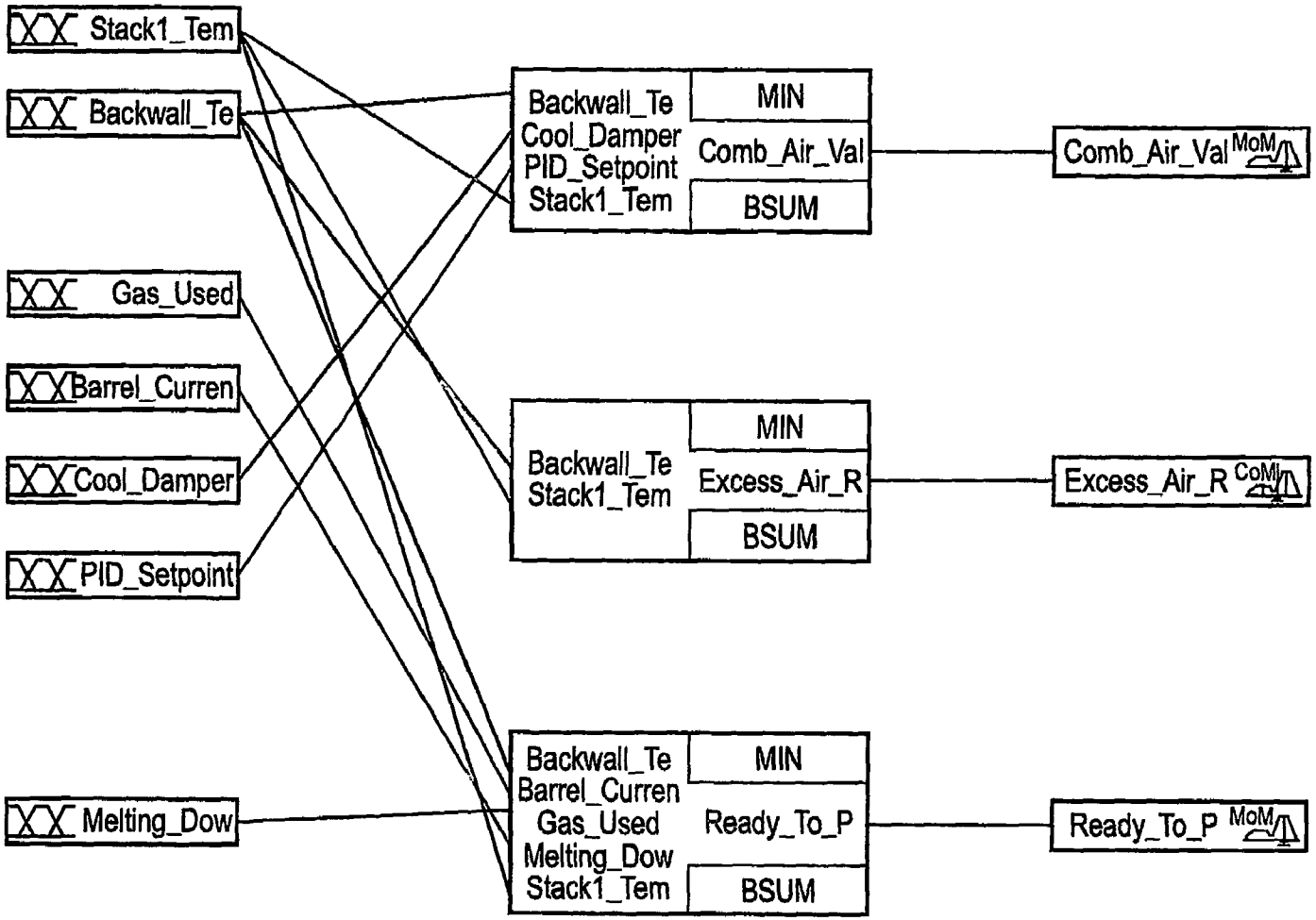
FIG. 7*a* is a system structure illustrating "fuzzy" logic inference flow processes for some examples and (without limitation) key decision steps in an artificial intelligence system.

Referring to FIGS. 7*a,b* and *c*, at least some of the above mentioned variables, together with others listed below, are identified as being important to the recovery rate and yield of aluminium. The variables (in no particular order of importance) are: refractory temperature, cycle time, recovery rate, metal temperature, flux, heat input, rotational speed, material type and alloy, method of loading and furnace tilt angle. Each of the aforementioned main variables have related sub-variables. For example, the main variable refractory, depends upon the following sub-variables: refractory temperature, total heat input and time period of heat input. Furnace skin temperature depends upon refractory temperature, the relationship of refractory temperature to furnace skin temperature over time, the variation in refractory temperature when Pouring metal, the variation in refractory temperature when charging metal and the refractory temperature when melting flux.

In essence, there may be ten or more main variables and several sub-variables, on which main variables depend that contribute to achieving the highest possible recovery rates. There are many different types of alloys that can be processed, all requiring individual parameters to optimise recovery rates. It is not possible to optimise each variable at any one time during the process, for example, too much heat input when the aluminium is in the plastic or melted stage will cause the aluminium to burn off due to its affinity with oxygen and therefore greatly reduce recoveries, this has an effect on the process cycle time. The amount of oxygen in the burner must be reduced at certain stages of the process cycle in order to maximise recovery but at the expense of fuel cost and cycle time.

The variables therefore require to be optimised when possible during and throughout the process. Previously, operating variable settings were determined by furnace operators throughout the process cycle, each individual operator having his own preference for each variable setting. There was therefore a loss of consistency in the variable settings during the process cycle. As a result the metal recovery rates varied.

The control aspect of the invention identifies sub-variables within the main variables and predicts (for example using algorithms or look-up tables) the impact of the main variables and the sub-variables on the overall process. Alternatively, or in addition to a microprocessor, artificial intelligence (for example in the form of a neural network or fuzzy logic rules) is ideally used to monitor and control the operation of the furnace.

An example of a variable which is controlled will now be described, for illustrative purposes only, with particular reference to FIGS. 7*b* and 7*c*. The particular variable is furnace skin temperature. Sensors 100, 102 and 104 sense temperature in three independent locations on the surface of the furnace body 12.

Information relating to the temperatures at these locations is transmitted to a SCADA 119, either directly or by way of a noise resistant bus. Data relating to these variables and other variables is transmitted to microprocessor 120. Microprocessor 120, under control of suitable software retrieves information from a look-up table 140 or from a store 130 of membership function data. Membership function data is derived from knowledge of a system's characteristics or may be obtained from interpolation, for example from graphical information of the type shown in FIG. 7*b*. This may be carried out digitally. Using fuzzy logic networks, of the type shown in FIG. 7*a*, microprocessor 120 computes, in this particular example any variation or trimming of air flow and/or gas (fuel) flow which may be needed to alter the internal temperature of the furnace 10.

Control signals generated by microprocessor 120 are transmitted to air pump 150 and gas supply 166 via control lines L1 and L2 respectively. Thus in this particular example knowledge of furnace skin temperatures T1, T2 and T3 can be used in conjunction with control system 200 to increase internal furnace temperature (and therefore the temperature of the contents of the furnace) by introducing more energy via burner 30.

Figure 7B:
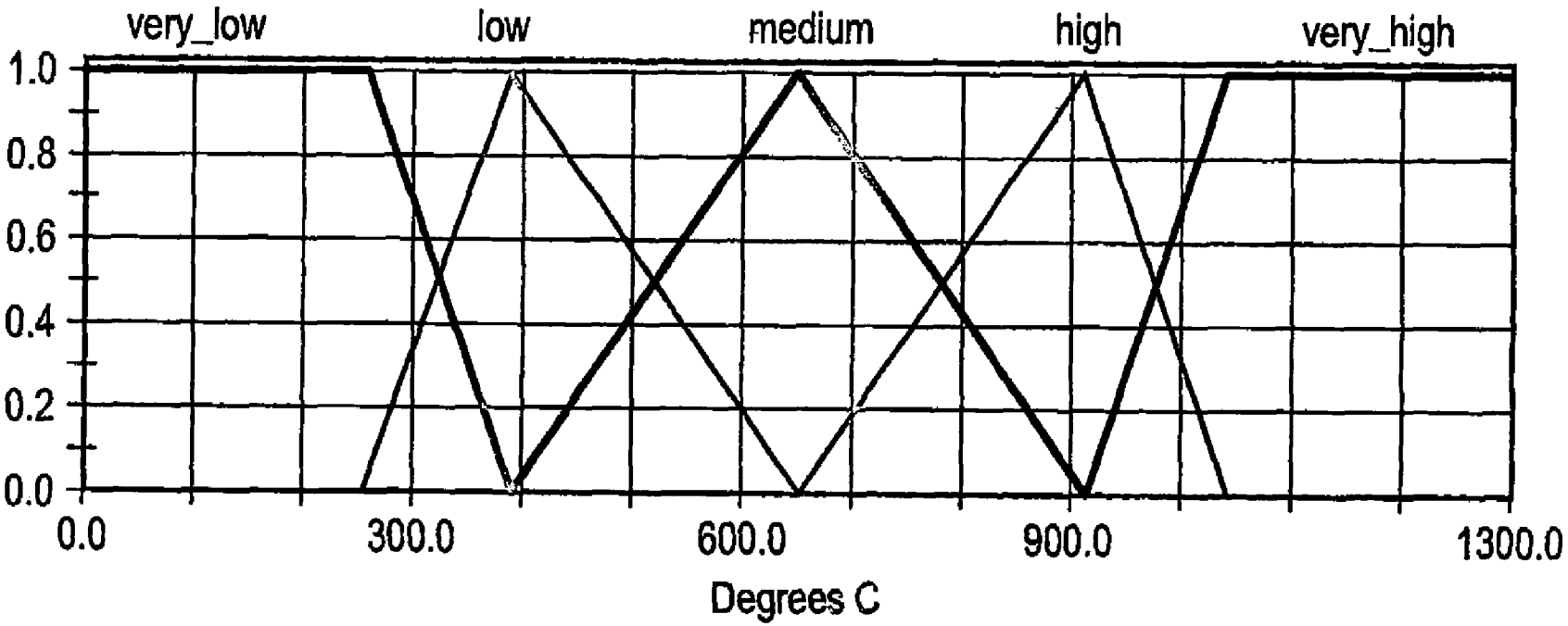
FIG. 7*b* is a chart illustrating membership functions, for example, of some variables, and (without limitation) some key decision steps in an artificial intelligence system.

FIG. 7*b* shows a graphical representation of a system structure that identifies fuzzy logic inference flow from input variables to output variables. The process in the input interfaces translates analog input signals into "fuzzy" values. The "fuzzy" inference takes place in so called rule blocks which contain linguistic control rules. These may vary according to a particular proprietary system. The output of these rule blocks is known as linguistic variables.

At the output stage the "fuzzy" variables are translated into analog variables which can be used as target variables to which a control system is configured to drive a particular piece of hardware, such as pump 150, motor 20 or valve 165 on gas supply line 166.

Table 1 in conjunction with FIGS. 7*a* and 7*b* shows how the "fuzzy" system including input interfaces, rule blocks and output interfaces are derived.

Connecting lines in FIG. 7*a* symbolize graphically the flow of data. Definition points on the graph (FIG. 7*b*) are shown relating to particular terms in the Table.

Figure 7C:
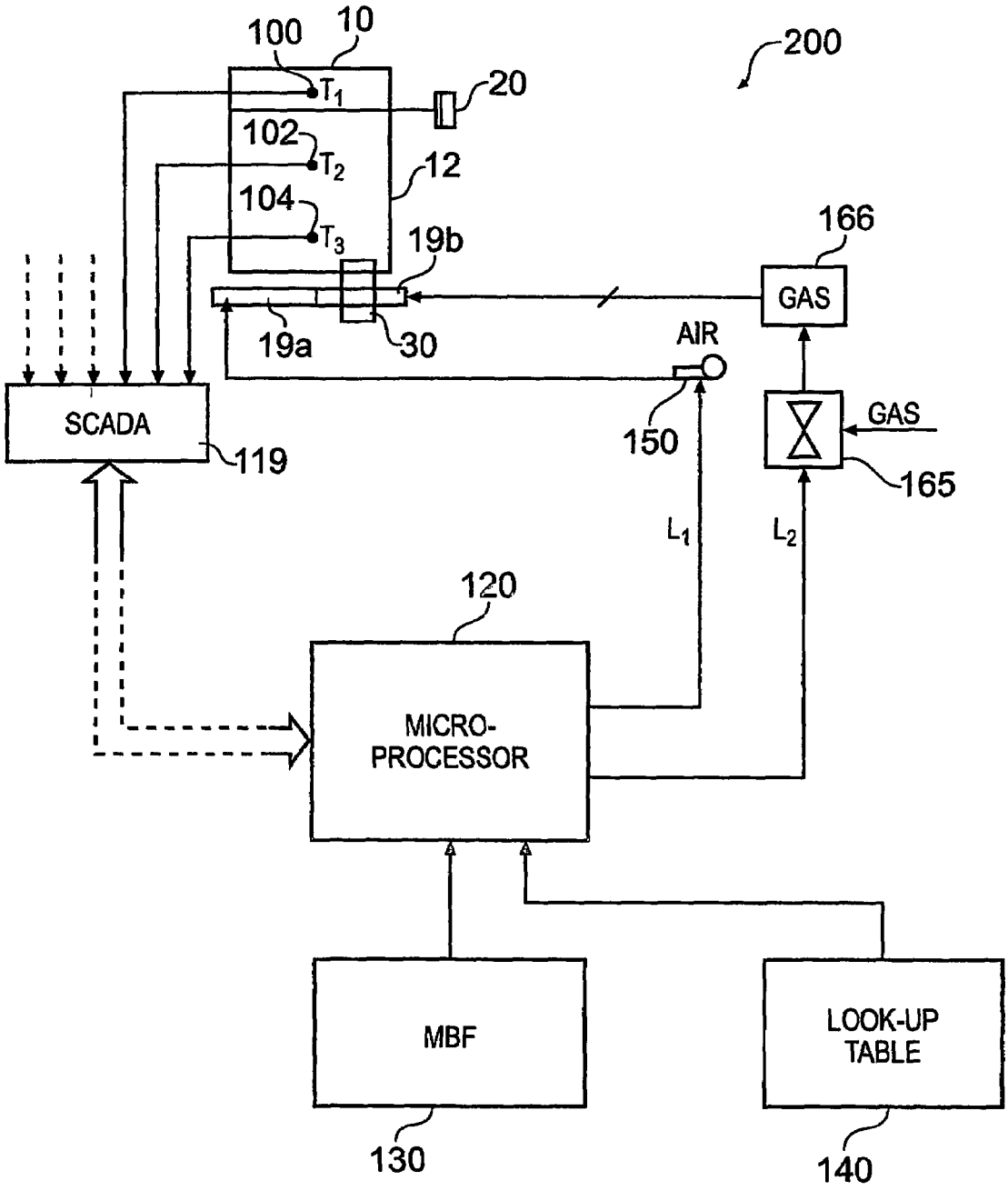
FIG. 7*c* is a flow diagram illustrating feedback control from the artificial intelligence system to gas and air supplies to the furnace and shows how furnace temperature is raised/lowered.

FIG. 7*c* shows how the furnace is controlled, by way of an example of only one variable—burner control—using information and control signals derived from the fuzzy logic process. It will be appreciated that many variables and sub-variables are simultaneously controlled by the system 200 and that control of temperature is described by way of example only.

The invention may take a form different to that specifically described above. For example modifications will be apparent to those skilled in the art without departing from the scope of the present invention.

TABLE 1

| Term Name | Shape/Par. | Definition Points (x, y) | | |
|---|---|---|---|---|
| very_low | linear | (0, 1)<br>(50, 0) | (10, 1) | (15, 0) |
| low | linear | (0, 0)<br>(25, 0) | (10, 0)<br>(50, 0) | (15, 1) |
| medium | linear | (0, 0)<br>(35, 0) | (15, 0)<br>(50, 0) | (25, 1) |
| high | linear | (0, 0)<br>(40, 0) | (25, 0)<br>(50, 0) | (35, 1) |
| very_high | linear | (0, 0)<br>(50, 1) | (35, 0) | (40, 1) |

The invention claimed is:

1. A furnace comprising:

a generally cylindrical furnace body having a closed end and an open end;

a frame pivoted to a ground member, said frame supporting said furnace body for rotation at various angles in a reclined position from said open end and in an inclined angle towards said open end;

a burner to heat said furnace; and, at least one hinged door, arranged to close said open end of said furnace;

wherein non-tapered walls of an interior of said furnace are substantially parallel and cylindrical from said open end to said closed end; and wherein said at least one hinged door is hinged to said frame and is capable of inclining and reclining in unison with raising and lowering of said furnace.

2. A furnace according to claim 1, further comprising:

means for raising and lowering said furnace so said furnace body is reclined in a position away from said open end and inclined in a position towards said open end of said furnace., respectively.

3. A furnace according to claim 2, wherein:

said means for raising and lowering said furnace comprises a hydraulic ram.

4. A furnace according to claim 1, wherein:

said inclined angle is less than 20°.

5. A furnace according to claim 4, wherein:

said inclined angle is less than 15°.

6. A furnace according to claim 4, wherein:

said inclined angle is less than 10°.

7. A furnace according to claim 1, wherein:

said at least one hinged door has at least one inspection hatch through which molten material can be poured.

8. A furnace according to claim 1, further comprising:

a fuel delivery system attached to said furnace, said fuel delivery system being adapted to raise and lower with said furnace.

9. A furnace according to claim 1, further comprising:

air and fuel delivery ducts through which combustion air and fuel pass to said burner, said air and fuel delivery ducts being defined by, or supported in, hinges of said at least one hinged door.

10. A furnace according to claim 9, wherein:

said air and fuel delivery ducts are in fluid communication with a fuel delivery system, said fuel delivery system having elbow and/or rotary fluid connections employing rotary joints that are gas tight.

11. A furnace according to claim 1, wherein:

said burner is mounted on said at least one hinged door so that, in use, heat is directed into said furnace body.

12. A furnace according to claim 11, wherein:

said burner is angled with respect to an axis of rotation of said furnace, so that, in use, flame from said burner does not impinge on said payload material being processed.

13. A furnace according to claim 1, further comprising:

one or more temperature sensors to sense a temperature of a refractory liner and molten material.

14. A furnace according to claim 1, further comprising:

means for generating an air curtain at said open end of said furnace, which air curtain, in use, permits variation of said internal furnace atmosphere with respect to said external (ambient) atmosphere.

15. A furnace according to claim 1, further comprising:

an exhaust port, and an air jet provided across said exhaust port to control pressure within said furnace, thereby enabling pressure balancing of said internal atmosphere.

16. A furnace according to claim 1, further comprising:

a drive motor arranged to rotate said furnace at a variable rotational speed.

17. A furnace according to claim 16, wherein said drive motor forms part of a furnace drive system comprising:

an electric motor;

a motor controller; and a linkage mechanism for transmitting torque from said electric motor to said furnace body.

18. A furnace according to claim 17, wherein:

said electric motor drives said furnace by way of a fixed linkage, said fixed linkage comprising at least one of a gear train, rack and pinion, and a chain drive.

19. A furnace according to claim 16, wherein:

said furnace drive system acts as a dynamic braking system by way of a controller, an inverter and said drive motor.

20. A furnace according to claim 17, further comprising:

a circumferential ring supporting gear teeth connected to said electric motor with a chain, said chain being adapted to engage with sprockets or gear teeth.

21. A furnace according to claim 20, wherein:

said number of gear teeth is half that of said chain pitch.

22. A furnace according to claim 21, further comprising:

variable packaging wedges to ensure a close fit between said circumferential ring and an outer surface of the said furnace body.

23. A furnace according to claim 22, wherein:

said packaging wedges are connected using a threaded member which, when tightened, causes said wedge to pinch said ring and ensure tight grip concentric with surface mounted lugs and said ring.

24. A furnace according to claim 1, further comprising:

temperature sensors disposed to measure and to provide an output signal indicative of a temperature of said at least one furnace door, a temperature of refractory linings, and a temperature of material being processed.

25. A furnace according to claim 1, further comprising:

means for receiving, encoding and transmitting signals relating to at least one of the following process variables: furnace skin temperatures, refractory temperatures, fuel gas and air flows, percentage oxygen of furnace atmosphere and internal furnace pressure.

26. A method of operating a furnace, comprising:

loading said furnace with a payload mixture of flux and a material to be melted from which metal is to be recovered;

maintaining a controlled furnace atmosphere, by sealing said furnace with one or more furnace doors;

heating said payload mixture until said metal melts;

agitating said mixture so as to promote agglomeration of said metal by rotating and counter-rotating said furnace and by reclining and inclining said furnace;

rotating said furnace in order to separate flux and molten; and raising one end of said furnace body in order to pour recovered metal.

27. A method of operating a furnace according to claim 26, further comprising:

rotating said furnace at a variable speed and inclining said furnace at varying angles to churn said material so as to assist in a transfer of heat into said material.

28. A method of operating a furnace according to claim 26, further comprising:

heating said furnace, in accordance with a control signal obtained from at least one sensor sensing at least the following: payload temperature; mass of payload; viscosity of said payload; time the payload takes to reach viscosity; atmospheric oxygen content of said furnace; rate of application of energy and cumulative energy applied.

29. A method of operating a furnace according to claim 28, wherein:

artificial intelligence is used to monitor and control operation of said furnace.

30. A method of operating a furnace according to claim 29, wherein:

a neural network is used to monitor and control operation of said furnace.

31. A method of operating a furnace according to claim 30, wherein:

fuzzy logic rules are used to monitor and control the operation of said furnace.

32. A method of operating a furnace. according to claim 28, further comprising:

on-line diagnosis of said process, remote access support, on-line monitoring and archiving.

33. A method of operating a furnace according to claim 32 , wherein:

remote access, data acquisition and on-line monitoring is achieved with a SCADA system.

34. A method of operating a furnace, comprising:

heating said furnace, in accordance with a control signal obtained from at least one sensor sensing at least the following: payload temperature; mass of payload; viscosity of said payload; time the payload takes to reach viscosity; atmospheric oxygen content of said furnace; rate of application of energy and cumulative energy applied;

loading said furnace with a payload mixture of flux and a material to be melted from which metal is to be recovered;

maintaining a controlled furnace atmosphere, by sealing said furnace with one or more furnace doors;

heating said payload mixture until said metal melts;

agitating said mixture so as to promote agglomeration of said metal by rotating and counter-rotating said furnace and by reclining and inclining said furnace;

rotating said furnace in order to separate flux and molten; and raising one end of said furnace body in order to pour recovered metal;

heating a furnace, in accordance with a control signal obtained from at least one sensor sensing at least the following: payload temperature; mass of payload; viscosity of said payload; time the payload takes to reach viscosity; atmospheric oxygen content of said furnace; rate of application of energy and cumulative energy applied;

identifying variables relating to sub-variables; and predicting impact that variation of a main variables and a sub-variable has on operation of said furnace.

35. A method of operating a furnace, comprising:

heating said furnace, in accordance with a control signal obtained from at least one sensor sensing at least the following: payload temperature; mass of payload; viscosity of said payload; time the payload takes to reach viscosity; atmospheric oxygen content of said furnace; rate of application of energy and cumulative energy applied;

loading said furnace with a payload mixture of flux and a material to be melted from which metal is to be recovered;

maintaining a controlled furnace atmosphere, by sealing said furnace with one or more furnace doors;

heating said payload mixture until said metal melts;

agitating said mixture so as to promote agglomeration of said metal by rotating and counter-rotating said furnace and by reclining and inclining said furnace;

rotating said furnace in order to separate flux and molten; and raising one end of said furnace body in order to pour recovered metal;

heating a furnace, in accordance with a control signal obtained from at least one sensor sensing at least the following: payload temperature; mass of payload; viscosity of said payload; time the payload takes to reach viscosity; atmospheric oxygen content of said furnace; rate of application of energy and cumulative energy applied; and using algorithms or look-up tables of variables and sub-variables.

36. A method of operating a furnace, comprising:

heating said furnace, in accordance with a control signal obtained from at least one sensor sensing at least the following: payload temperature; mass of payload; viscosity of said payload; time the payload takes to reach viscosity; atmospheric oxygen content of said furnace; rate of application of energy and cumulative energy applied;

loading said furnace with a payload mixture of flux and a material to be melted from which metal is to be recovered;

maintaining a controlled furnace atmosphere, by sealing said furnace with one or more furnace doors;

heating said payload mixture until said metal melts;

agitating said mixture so as to promote agglomeration of said metal by rotating and counter-rotating said furnace and by reclining and inclining said furnace;

rotating said furnace in order to separate flux and molten; and raising one end of said furnace body in order to pour recovered metal;

heating a furnace, in accordance with a control signal obtained from at least one sensor sensing at least the following: payload temperature; mass of payload; viscosity of said payload; time the payload takes to reach viscosity; atmospheric oxygen content of said furnace; rate of application of energy and cumulative energy applied;

obtaining one or more feedback signals;

making a comparison made between predicted and actual performance; and deriving a correction signal to effect a change in a variable.

37. A method of operating a furnace according to claim 36, wherein:

a microprocessor is used to monitor and control said operation of said furnace.

* * * * *